US005215843A

United States Patent [19]

Aizawa

[11] Patent Number: 5,215,843

[45] Date of Patent: Jun. 1, 1993

[54] PHOTOCONDUCTOR FOR ELECTROPHOTOGRAPHY WITH PHOSPHORUS CONTAINING INTERLAYER

[75] Inventor: Koichi Aizawa, Kawasaki, Japan

[73] Assignee: Fuji Electric Co., Ltd., Kawasaki, Japan

[21] Appl. No.: 878,990

[22] Filed: May 6, 1992

Related U.S. Application Data

[62] Division of Ser. No. 794,976, Nov. 20, 1991.

[30] Foreign Application Priority Data

Nov. 22, 1990 [JP] Japan ..... 2-318302
Mar. 25, 1991 [JP] Japan ..... 3-59258

[51] Int. Cl.[5] ..... G03G 5/14

[52] U.S. Cl. ..... 430/65; 430/58; 430/59; 430/60

[58] Field of Search ..... 430/60, 63, 65

[56] References Cited

U.S. PATENT DOCUMENTS 3,795,516 3/1974 Stahr et al. ..... 430/64 X
4,282,294 8/1981 Lee et al. ..... 430/64 X
4,871,635 10/1989 Seki et al. ..... 430/60

FOREIGN PATENT DOCUMENTS 10138 1/1977 Japan .
25638 2/1977 Japan .
30757 2/1983 Japan .
63945 4/1983 Japan .
95351 6/1983 Japan .
98739 6/1983 Japan .
105155 6/1983 Japan .
66258 4/1985 Japan .
61-286200 12/1986 Japan .
62-61057 3/1987 Japan .
63-025661 2/1988 Japan .
63-216059 9/1988 Japan .
234261 9/1988 Japan ..... 430/65

OTHER PUBLICATIONS

"Xerography and Related Processes", Dessmer and Clark, 1965, p. 41.
Hackh's Chemical Dictionary, 1969, p. 515.

*Primary Examiner*—Roland Martin
*Attorney, Agent, or Firm*—Spencer, Frank & Schneider

[57] ABSTRACT

A separate-function laminate-type photoconductor for electrophotography includes a photosensitive substrate having a subbing layer and a photosensitive layer laminated on the substrate in this order, in which the subbing layer is composed of a resin containing phosphorus in an amount within the range of 30 to 500 ppm by weight based on the resin. The resin for the subbing layer is preferably an epoxy resin. The photoconductor has a high sensitivity, a good ability to electrified and a low residual potential, and gives less variation in its characteristics due to environmental factors to give an image of a good quality constantly.

5 Claims, 1 Drawing Sheet

PHOTOCONDUCTOR FOR ELECTROPHOTOGRAPHY WITH PHOSPHORUS CONTAINING INTERLAYER

This is a division of application Ser. No. 07/794,976 filed Nov. 20th, 1991.

BACKGROUND OF THE INVENTION

1. Field of the Invention

The present invention relates to a photoconductor for electrophotography, and more particularly to a photoconductor for electrophotography which includes an electroconductive substrate having laminated thereon a subbing layer and a photosensitive layer in this order.

2. Description of Prior Art

Recently, as photoconductors for electrophotography (hereafter, sometimes referred to simply as "photoconductors") for use in copiers or printers utilizing an electrophotographic system, those photoconductors which include organic photo-sensitive materials having various advantages such as low costs, high productivities and low environmental pollutions have been prevailing.

Various types of organic photoconductors have been known, including photoconductive resin type photoconductors represented by polyvinylcarbazole (PVK), charge transfer complex photoconductors represented by polyvinylcarbazole-2,4,7-trinitrofluorenone (PVK-TNF), and function-separated type photoconductors utilizing a charge generating substance and a charge transporting substance in combination. Particularly, function-separated, laminate type photoconductors are being given much attention.

The organic photoconductors of function-separated type with high sensitivities, when used in the Carlson process, generally have disadvantages including that they have a low ability to be electrified, a poor ability to maintain surface charge (high dark attenuation) and, in addition, such abilities decrease greatly in repeated use, with the result that uneven density and/or fogging occurs in images obtained and contamination tends to occur in the case of a reversal development system.

In order to obviate the aforementioned disadvantages, use has been made of an interlayer between an electroconductive substrate and a photosensitive layer. This interlayer serves as a subbing layer for the photosensitive layer. For example, provision of a nylon type resin interlayer is disclosed in, for example, Japanese Patent Application Laying-Open No. 47344/1973, Japanese Patent Application Laying-Open No. 25638/1977, Japanese Patent Application Laying-Open No. 30757/1983, Japanese Patent Application Laying-Open No. 63945/1983, Japanese Patent Application Laying-Open No. 95351/1983, Japanese Patent Application Laying-Open No. 98739/1983 and Japanese Patent Application Laying-Open No. 66258/1985; provision of a maleic acid type resin interlayer is disclosed in Japanese Patent Application Laying-Open No. 69332/1974 and Japanese Patent Application Laying-Open No. 10138/1977; and provision of a polyvinyl alcohol resin interlayer is disclosed in Japanese Patent Application Laying-Open No. 105155/1983.

However, in many cases, the aforementioned subbing layer is made of an insulating resin, which increases the residual voltage of the photoconductor, and giving poor contrast in the image obtained. Although use of a polyamide resin (e.g., nylon) having a low electric resistance can suppress increase in the residual potential, a new problem arises in that variation of the properties of the photoconductor increases due to moisture in the environment because the polyamide resin has a high water absorption.

SUMMARY OF THE INVENTION

It is an object of the present invention to overcome the aforementioned problems and provide a photoconductor which has a high sensitivity, a good ability to be electrified and a low residual potential, and gives less variation in its characteristics due to environmental factors to give an image of a good quality constantly.

Therefore, according to one aspect of the present invention, there is provided a photoconductor for electrophotography having an electroconductive substrate, a subbing layer laminated on the substrate and a photosensitive layer laminated on the subbing layer, wherein the subbing layer is composed essentially of:

a resin, and phosphorus in an amount within the range of from about 30 to about 500 ppm by weight based on weight of the resin.

Here, the resin may be an epoxy resin.

According to another aspect of the present invention, there is provided a photoconductor for electrophotography having an electroconductive substrate, a subbing layer laminated on the substrate and a photosensitive layer laminated on the subbing layer, wherein the subbing layer is composed essentially of:

a polyvinyl alcohol, and a boron-containing compound represented by formula (I) below:

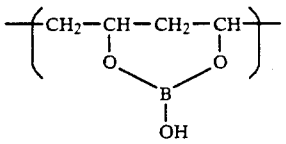

(I)

in an amount of 1.5 to 10% by weight based on weight of the subbing layer.

Here, the subbing layer may further comprise an alcohol-soluble polyamide in an amount of 50% by weight or less based on weight of the polyvinyl alcohol.

Other objects, advantages and effects will be apparent from the following description with reference to the accompanying drawing.

DETAILED DESCRIPTION OF PREFERRED EMBODIMENTS

Figure 1:
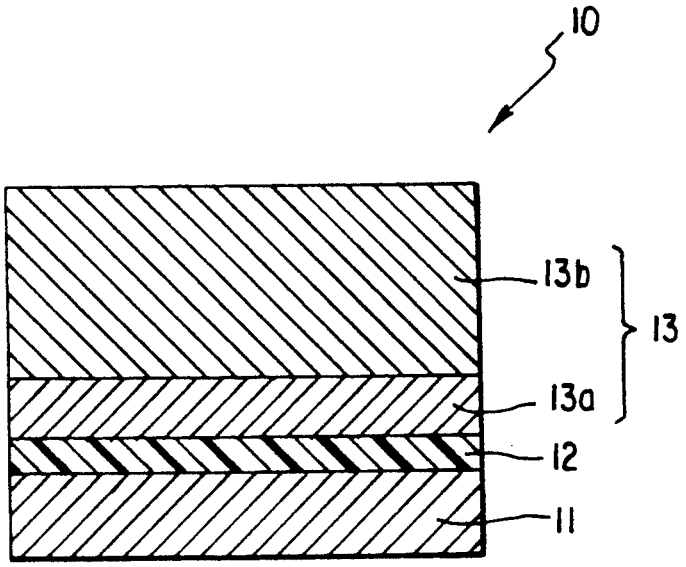
FIG. 1 is a schematic cross sectional view of a photodonductor according to one embodiment of the present invention.

Referring to FIG. 1, a photoconductor 10 according to one embodiment of the present invention comprises an electroconductive substrate 11. The substrate 11 has a subbing layer 12. A photosensitive layer 13 is provided on the subbing layer 12. The photosensitive layer 13 includes a charge generating layer **13*a* and a charge transporting layer 13*b* laminated in this order on the subbing layer 12**.

Various materials can be used as the electroconductive substrate 10. For example, cylindrical plastics or papers may be used which are coated with a metal such as aluminum, nickel, chromium, nichrome, copper, silver, gold or platinum, or a metal oxide such as tin oxide or indium oxide by vapor deposition or sputtering. Alternatively, there may be used metal plates which are made of aluminum, aluminum alloy, nickel or stainless steel and surface-treated by super-finishing, grinding or the like, or metal pipes fabricated by D.I. (direct injection), I.I. (indirect injection), extrusion, drawing or the like of a metal such as aluminum, aluminum alloys, nickel or stainless steel to prepare a raw pipe and surface treating the pipe by cutting, superfinishing, grinding or the like.

The subbing layer 12 is made of a resin containing phosphorus in a small amount, i.e., in an amount effective for preventing variation of characteristics thereof.

The resin which constitutes the subbing layer 12 may be a thermoplastic resin such as a polyamide, a polyester, a vinyl chloride/vinyl acetate copolymer, or a thermosetting resin, for example, one obtained by thermal polymerization of a compound containing a plurality of active hydrogens (hydrogens in, for example, —OH groups, —$NH_2$ groups, and —NH groups) with a compound having a plurality of isocyanate groups and/or a compound having a plurality of epoxy groups. Among them, an epoxy resin is preferred because it can give a photoconductor exhibiting less variation of its characteristics due to environmental factors.

When an epoxy resin is used for the subbing layer, the content of phosphorus may be preferably within the concentration range of from 30 to 500 ppm by weight, and more preferably from 50 to 200 ppm by weight, based on the weight of the epoxy resin. When the content of phosphorus is less than 30 ppm by weight no satisfactory effect can be obtained while use of phosphorus in an amount of more than 500 ppm by weight results in much decreased ability of being electrified and therefore use of phosphorus in amounts outside the aforementioned concentration range is undesirable.

On the other hand, a photoconductor which has a high sensitivity, a good ability to electrified and a low residual potential, and shows less variation in its characteristics due to environmental factors, thus giving an image of a good quality constantly, particularly a photoconductor which suffers from less decrease in the sensitivity at a low temperature and a low humidity, can also be obtained by forming the subbing layer with a polyvinyl alcohol resin containing a boron-containing compound represented by formula (I) above. In this case, the subbing layer may contain an alcohol-soluble polyamide resin in amounts within the range of 50% by weight or less based on the weight of the subbing layer.

The amount of the boron-containing compound represented by formula (I) above may be 1.5 to 10% by weight based on the weight of the polyvinyl alcohol. When the boron-containing compound is present in an amount less than 1.5% by weight, the aforementioned effects will be insufficient, while when the amount of the boron-containing compound exceeds 10% by weight, the ability to be electrified undesirably decreases. On the other hand, the content of boron may preferably be 310 ppm by weight or more.

The subbing layer 12 may be 0.1 to 20 μm thick, preferably 0.3 to 10 μm thick.

Generally, the charge generating layer 13*a* is composed mainly of a charge generating substance and may contain a binder resin, if desired. Examples of the charge generating substance include a phthalocyanine pigment such as metal-free phthalocyanine or aluminum phthalocyanine, an azulenium salt, an azo pigment, etc. The thickness of the charge generating layer 13*a* may be on the order of 0.01 to 5 μm, preferably 0.03 to 2 μm.

The charge transporting layer 13*b* can be formed by coating and drying a coating solution prepared by dissolving or dispersing a charge generating substance and an optional binder resin in a suitable solvent. Examples of the charge generating substance include electron-donating substances such as hydrazone, pyrazoline, butadiene, poly-N-vinylcarbazole and derivatives thereof, poly-γ-carbazolylethyl glutamate and derivatives thereof, pyrene/formaldehyde condensate and derivatives thereof, polyvinylpyrene, polyvinylphenanthrene, oxazole derivatives, oxadiazole derivatives, imidazole derivatives, triphenylamine derivatives, 9-(p-diethylamino-styryl)anthracene, 1,1-bis(4-dibenzyldiamino-phenyl)propane, styrylanthracene, styrylpyrazoline, phenylhydrazones, α-phenylstilbene derivatives, etc. The charge transporting layer 13*b* may contain a plasticizer, an ultraviolet absorbent, an antioxidant, a leveling agent, etc., if desired.

As the binder resin which can be used for the charge generating layer 13*a* and the charge transporting layer 13*b*, there can be cited, for example, thermoplastic resins or thermosetting resins such as polystyrenes, styrene/acrylonitrile copolymers, styrene/butadiene copolymers, styrene/maleic anhydride copolymers, polyesters, polyvinyl chlorides, vinyl chloride/vinyl acetate copolymers, polyvinyl acetates, polyvinylidene chlorides, polyarylate resins, phenoxy resins, polycarbonates, cellulose acetate resins, ethylene cellulose resins, polyvinyl butyrals, polyvinyl formals, polyvinyltoluenes, polyvinylcarbazoles, acrylic resins, silicone resins, epoxy resins, melamine resins, urethane resins, phenol resins, alkyd resins, etc.

EXAMPLES

Hereafter, the present invention will be described in more detail by way of examples. However, the present invention should not be construed as being limited by the examples.

EXAMPLE 1

A mixture of 100 g of an 18% methyl ethyl ketone solution of an epoxy resin (ABLEBOND 150-4, trade name for a product by Japan Ablestick Co., Ltd.) and 0.2 g of $P_2O_5$ powder was charged in a hard glass pot together with sintered alumina balls, and milled in a ball mill for 24 hours to prepare a coating solution for preparing a subbing layer. The coating solution was coated on an aluminum substrate by a blading method, and dried at 100° C. for 3 hours to form a subbing layer of 3 μm thick.

On the subbing layer was coated by a blading method a coating solution prepared by mixing 100 parts by weight of metal-free phthalocyanine, 100 parts by weight of polyvinyl butyral and 3000 parts by weight of dichloromethane and milling the mixture in a ball mill for 24 hours to form a charge generating layer of 0.2 μm thick.

Then, a solution, in 800 parts by weight of dichloromethane, of 100 parts by weight of a charge transporting substance represented by formula (II) below:

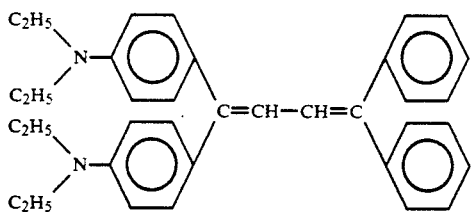

(II)

which is a butadiene derivative, more specifically 1,1-bis(p-diethylaminophenyl)-4,4-diphenyl-1,3-butadiene, and 100 parts by weight of a polycarbonate (UPIRON Z-200, trade name for a product by Mitsubishi Gas Chemical Co., Ltd.) was coated by a blading method on the charge generating layer to form a charge transporting layer of 16 μm thick. Thus, a photoconductor was obtained.

COMPARATIVE EXAMPLE 1

A photoconductor was prepared in the same manner as in Example 1 except that no subbing layer was provided.

COMPARATIVE EXAMPLE 2

A photoconductor was prepared in the same manner as in Example 1 except that the subbing layer was formed with an alcohol-soluble polyamide resin (AMILAN CM8000, trade name for a nylon manufactured by Toray Ltd.) in a thickness of 3 μm.

The electrophotographic characteristics of the photoconductors thus obtained were measured using an electrostatic recording paper testing apparatus (Kawaguchi Denki Model SP-428).

The surface potential Vs (volts) of each photoconductor is an initial surface potential which was measured when the surface of each photoconductor was positively charged in the dark by corona discharge at −6.0 kV for 10 seconds. After the discontinuation of the corona discharge, each photoconductor was allowed to stand in the dark for 5 seconds, after which the surface potential Vd (volts) of each photoconductor was measured. Subsequently, the surface of each photoconductor was irradiated with a 1 μW monochromatic light (a wavelength of 780 nm) and the time (seconds) required for the irradiation to decrease the surface potential of each photoconductor to half of Vd was measured, from which the half decay exposure amount $E_{\frac{1}{2}}$ (lux.sec) was then calculated. Also, the surface potential of each photoconductor after 10 seconds of irradiation thereof with the monochromatic light was measured as a residual potential Vr (volts). In addition, the photoconductors were fitted in a semiconductor laser beam printer and printing was conducted. The characteristics of images obtained were evaluated. Results obtained are shown in Table 1.

The measurement and evaluation above were performed under the conditions of 25° C. and at a relative humidity of 50%. In order to examine dependence of the characteristics of the photoconductors on the environmental factors, measurement of characteristics and evaluation of printed images were also performed at 10° C. and at a relative humidity of 30%, and at 35° C. and at a relative humidity of 85%. Results obtained are shown in Table 1.

TABLE 1

| Run | Vs (volt) | $E_{\frac{1}{2}}$ (μJ/cm²) | Vr (volt) | Image | Dependence on Environment |
|---|---|---|---|---|---|
| Example 1 | −630 | 0.40 | −40 | good | low |
| Comparative Example 1 | −600 | 0.42 | −35 | poor (fog) | low |
| Comparative Example 2 | −635 | 0.39 | −38 | good | high |

As can be seen in Table 1, the photoconductor having no subbing layer according to Comparative Example 1 had a problem in the printed image, while the photoconductor with a polyamide resin in the subbing layer according to Comparative Example 2 had a poor sensitivity under the environmental conditions of 10° C. and a relative humidity of 30%, as well as a decreased ability to electrified at 35° C. and at a relative humidity of 85%. On the contrary, the photoconductor according to Example 1 showed little variation in the characteristics thereof and gave a good image under the respective conditions. This clearly demonstrated the effectiveness of the subbing layer in Example 1.

EXAMPLE 2

Photoconductors with varied contents of phosphorus in the respective subbing layers were prepared in the same manner as in Example 1 except that the amounts of $P_2O_5$ to be added upon preparing the coating solution for the subbing layers were changed from 0 to 30,000 ppm.

The characteristics of the photoconductors were measured at 25° C. and at a relative humidity of 50% in the same manner as in Example 1. Results obtained are shown in Table 2.

TABLE 2

| Phosphorus Content in the Subbing Layer (ppm) | Vs (Volt) | $E_{\frac{1}{2}}$ (μJ/cm²) | Vr (Volt) | Evaluation |
|---|---|---|---|---|
| 0 | −750 | 0.58 | −250 | poor |
| 3 | −740 | 0.57 | −150 | poor |
| 10 | −700 | 0.50 | −100 | poor |
| 30 | −650 | 0.41 | −50 | fair |
| 50 | −630 | 0.40 | −45 | excellent |
| 100 | −630 | 0.40 | −40 | excellent |
| 200 | −620 | 0.38 | −38 | excellent |
| 500 | −610 | 0.38 | −35 | fair |
| 1,000 | −500 | 0.30 | −20 | poor |
| 10,000 | −300 | 0.25 | −10 | poor |
| 30,000 | −200 | 0.21 | −5 | poor |

As can be seen in Table 2, a preferred content of phosphorus in the subbing layer was found to be within the range of 30 to 500 ppm by weight.

EXAMPLE 3

On an aluminum substrate was coated a coating material composed of a polyvinyl alcohol (PVA) containing 2.9 g per 100 g of PVA, i.e., 7.4% by weight based on the weight of PVA (B (boron) content: 600 ppm by weight) of a boron-containing compound represented by formula (I) below:

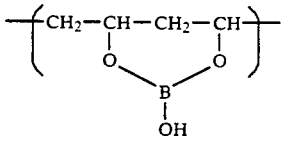

(I)

(NMK-37, trade name for a product by Tokyo Oka Co., Ltd.), and dried at 100° C. for 2 hours to form a subbing layer of 5 μm thick.

On the subbing layer were formed a charge generating layer and a charge transporting layer in this order to obtain a photoconductor.

COMPARATIVE EXAMPLE 3

A photoconductor was prepared in the same manner as in Example 3 except that the subbing layer was formed with an alcohol-soluble polyamide resin (AMILAN CM8000, trade name for a nylon manufactured by Toray Ltd.) in a thickness of 5 μm.

The electrophotographic characteristics of the photoconductors thus obtained were measured using an electrostatic recording paper testing apparatus (Kawaguchi Denki Model SP-428).

The surface potential Vs (volts) of each photoconductor is an initial surface potential which was measured when the surface of each photoconductor was positively charged in the dark by corona discharge at −6.0 kV for 10 seconds. After the discontinuation of the corona discharge, each photoconductor was allowed to stand in the dark for 5 seconds, after which the surface potential Vd (volts) of each photoconductor was measured. Subsequently, the surface of each photoconductor was irradiated with a 1 μW monochromatic light (a wavelength of 780 nm) for 1 second and the surface potential was measured to obtain an exposure potential Vi (volts). Also, the surface potential of each photoconductor after 10 seconds of irradiation thereof with the monochromatic light was measured as a residual potential Vr (volts). The measurement was performed under the conditions of 10° C. and a relative humidity of 30%, 25° C. and a relative humidity of 50%, and 35° C. and a relative humidity of 85% in order to examine dependence of the characteristics of the photoconductors on environmental factors, as well as examine variation of each characteristic ΔV. Results obtained are shown in Table 3.

TABLE 3

| Run | Item Measured (volt) | Environment for Measurement: Temperature (°C.) Relative Humidity (%) 10° C. 30% | 25° C. 50% | 35° C. 85% | ΔV (volt) | Evaluation |
|---|---|---|---|---|---|---|
| Example 3 | Vd | −600 | −610 | −605 | 10 | fair |
| | Vi | −120 | −105 | −90 | 30 | fair |
| | Vr | −30 | −25 | −20 | 10 | fair |
| Comparative | Vd | −600 | −610 | −550 | 50 | poor |
| | Vi | −290 | −130 | −80 | 200 | poor |
| | Vr | −200 | −40 | −20 | 180 | poor |

As can be seen in Table 3, the superiority of the subbing layer in the photoconductor obtained in Example 3 was evident.

EXAMPLE 4

A photoconductor was prepared in the same manner as in Example 1 except that the charge generating layer was replaced by one formed by sublimating dibromoanthanthrone in vacuum and having a thickness of 0.1 μm.

COMPARATIVE EXAMPLE 4

A photoconductor was obtained in the same manner as in Example 4 except that the subbing layer was replaced by the one formed according to Comparative Example 3.

The characteristics of the photoconductors of Example 4 and Comparative Example 4 were measured in the same manner as in Example 3 except that the light illuminated was changed to a 1 μW light having a wavelength of 540 nm. Results obtained are shown in Table 4.

TABLE 4

| Run | Item Measured (volt) | Environment for Measurement: Temperature (°C.) Relative Humidity (%) 10° C. 30% | 25° C. 50% | 35° C. 85% | ΔV (volt) | Evaluation |
|---|---|---|---|---|---|---|
| Example 4 | Vd | −790 | −810 | −770 | 40 | fair |
| | Vi | −140 | −120 | −90 | 50 | fair |
| | Vr | −55 | −30 | −10 | 45 | fair |
| Comparative Example 4 | Vd | −800 | −820 | −730 | 70 | poor |
| | Vi | −210 | −140 | −100 | 110 | poor |
| | Vr | −145 | −40 | −30 | 115 | poor |

As can be seen in Table 3, the photoconductor with the different subbing layer obtained in Example 3 was found to be also effective.

EXAMPLE 5

Photoconductors were prepared in the same manner as in Example 3 except that the coating solution was changed to those to which an alcohol-soluble polyamide resin (AMILAN CM4000, trade name for a nylon manufactured by Toray Ltd.) was added in proportions shown in Table 5. The characteristics of the photoconductors obtained were evaluated in the same manner as in Example 3. Results obtained are shown in Table 5 together with the compositions of the corresponding coating solution for preparing the respective subbing layers.

TABLE 5

| Content of Alcohol-Soluble Polyamide Resin (wt. %) | Content of Boron (ppm) | Item Measured (volt) | Environment for Measurement: Temperature (°C.) Relative Humidity (%) 10° C. 30% | 25° C. 50% | 35° C. 85% | ΔV (volt) | Evaluation |
|---|---|---|---|---|---|---|---|
| 0 | 420 | Vd | −595 | −625 | −610 | 30 | good |
| | | Vt | −130 | −110 | −90 | 40 | good |

TABLE 5-continued

| Content of Alcohol-Soluble Polyamide Resin (wt. %) | Content of Boron (ppm) | Item Measured (volt) | Environment for Measurement: Temperature (°C.) Relative Humidity (%) 10° C. 30% | 25° C. 50% | 35° C. 85% | ΔV (volt) | Evaluation |
|---|---|---|---|---|---|---|---|
| 10 | 400 | Vd | −600 | −610 | −585 | 25 | good |
| | | Vt | −140 | −120 | −80 | 60 | good |
| 20 | 380 | Vd | −595 | −615 | −590 | 25 | good |
| | | Vt | −140 | −120 | −90 | 50 | good |
| 30 | 360 | Vd | −600 | −605 | −575 | 30 | good |
| | | Vt | −160 | −130 | −80 | 80 | good |
| 40 | 340 | Vd | −600 | −610 | −585 | 25 | good |
| | | Vt | −170 | −120 | −90 | 80 | good |
| 50 | 310 | Vd | −600 | −625 | −600 | 25 | good |
| | | Vt | −190 | −110 | −90 | 100 | fair |
| 60 | 270 | Vd | −595 | −600 | −565 | 35 | fair |
| | | Vt | −230 | −120 | −80 | 150 | poor |
| 70 | 220 | Vd | −600 | −615 | −580 | 35 | fair |
| | | Vt | −310 | −110 | −85 | 225 | poor |
| 80 | 160 | Vd | −600 | −600 | −550 | 50 | poor |
| | | Vt | −420 | −95 | −75 | 345 | poor |
| 90 | 90 | Vd | −590 | −620 | −560 | 60 | poor |
| | | Vt | −350 | −115 | −80 | 270 | poor |
| 100 | 0 | Vd | −600 | −625 | −550 | 75 | poor |
| | | Vt | −290 | −130 | −85 | 205 | poor |

As can be seen in Table 5, the use of the polyvinyl alcohol containing the boron-containing compound represented by formula (I) together with the alcohol-soluble polyamide in the subbing layer gave rise to good photoconductors showing less Vi increase at low temperatures and at low humidities and less Vd decreases at high temperatures and at high humidities so long as the mixing ratio of the polyamide was 50% by weight or less. From this it follows that the amount of the polyvinyl alcohol, which is expensive, can be reduced considerably.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

an electroconductive substrate;

a subbing layer laminated on the substrate; and a photosensitive layer laminated on the subbing layer, wherein said subbing layer is comprised of:

a resin, and phosphorus from an inorganic source in an amount within the range of from about 30 to about 500 ppm by weight based on weight of said resin.

2. The photoconductor for electrophotography as claimed in claim 1, wherein said resin is an epoxy resin.

3. The photoconductor for electrophotography as claimed in claim 1, wherein the phosphorus is obtained from phosphorus pentoxide, $P_2O_5$.

4. A photoconductor for electrophotography, comprising:

an electroconductive substrate;

a subbing layer laminated on the substrate; and a photosensitive layer laminated on the subbing layer, wherein said subbing layer is comprised of:

a resin, and phosphorus pentoxide in an amount within the range of from about 30 to about 500 ppm by weight based on weight of said resin.

5. The photoconductor for electrophotography as claimed in claim 4, wherein said resin is an epoxy resin.

* * * * *